United States Patent [19]

Andersson

[11] Patent Number: 4,857,146

[45] Date of Patent: Aug. 15, 1989

[54] PROCESS FOR INCREASING THE SOLIDS CONTENT OF BLACK LIQUOUR AT ITS RECOVERY IN A SULFATE PULPING PROCESS

[76] Inventor: Alf O. Andersson, 38 Kofallsägen, S-710 40 Frövi, Sweden

[21] Appl. No.: 871,553

[22] Filed: Jun. 6, 1986

[30] Foreign Application Priority Data

Jun. 7, 1985 [SE] Sweden ..... 8502833

[51] Int. Cl.[4] ..... D21C 11/12

[52] U.S. Cl. ..... 162/31; 162/46; 162/47; 162/49; 162/61; 423/DIG. 3; 159/2.1; 159/47.3

[58] Field of Search ..... 162/47, 49, 31, 61, 162/46; 423/DIG. 3; 159/2.1, 47.3

[56] References Cited

U.S. PATENT DOCUMENTS 3,432,402 3/1969 Herrlinger et al. ..... 159/47.3 X

FOREIGN PATENT DOCUMENTS 8100687 6/1981 Sweden .
8204419 7/1982 Sweden .

*Primary Examiner*—Peter Chin
*Assistant Examiner*—Thi Dang
*Attorney, Agent, or Firm*—Burns, Doane, Swecker & Mathis

[57] ABSTRACT

The invention relates to a process of increasing the solids content of black liquor at its recovery in a sulfate pulping process. According to the invention, the liquor is first heated at a pressure which is so high that no boiling occurs at the heating temperature, after which the liquor is led to a tank where its pressure is released to a value below the saturation pressure of steam at the relative temperature of the liquor such that water is evaporated. The liquor thus concentrated can be led to the liquor combustion in the recovery process.

12 Claims, 1 Drawing Sheet

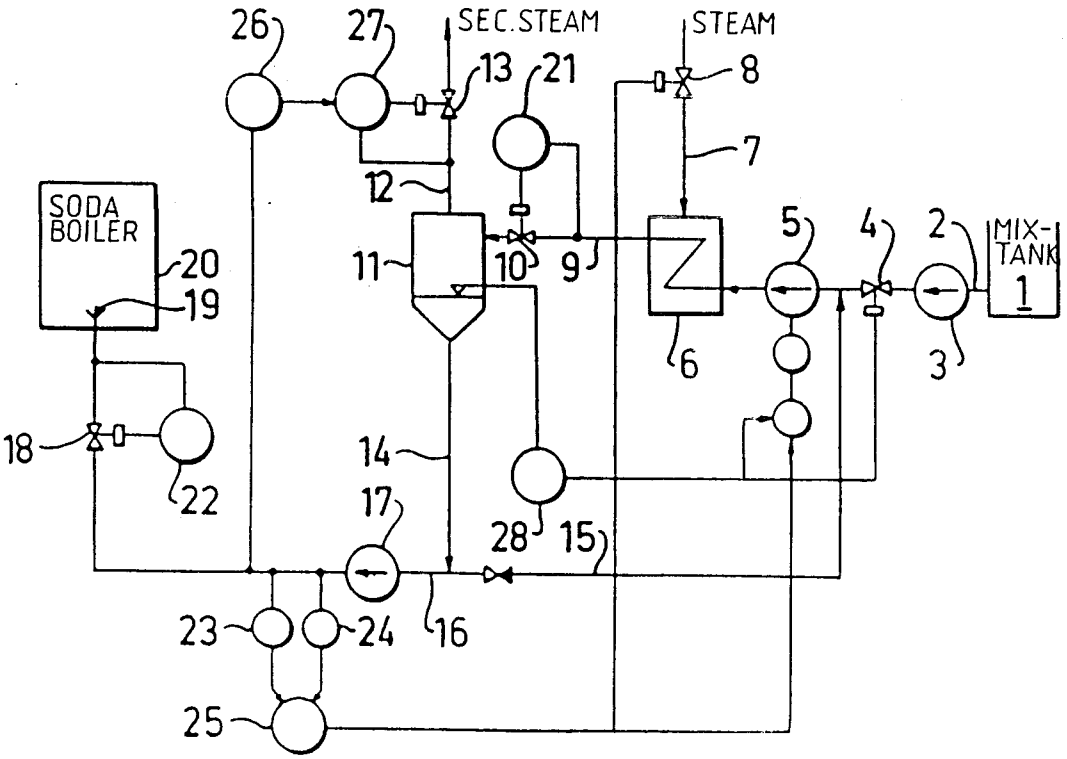
MIX-TANK
1
2
3
4
5
6
7
8
STEAM
9
10
11
12
13
SEC.STEAM
14
15
16
17
18
19
20
SODA BOILER
21
22
23
24
25
26
27
28

PROCESS FOR INCREASING THE SOLIDS CONTENT OF BLACK LIQUOUR AT ITS RECOVERY IN A SULFATE PULPING PROCESS

In the liquor recovery in sulfate pulping processes the black liquor obtained from the pulping process is usually evaporated to a suitable solids content such that it can then be burned in the soda recovery boiler. At the combustion, molten sodium carbonate and sodium sulfide are obtained, which after dissolution are led to causticizing for preparation of new white liquor for the pulping process. By this, the inorganic constituents of the liquor are recovered for repeated use, while the organic material dissolved from the wood is burned and yields an essential contribution of energy in the total process.

The evaporation of the black liquor is usually carried out in several steps and is at present usually not carried further than to a solids content of about 65% (calculated on weight). Thus, a considerable amount of water accompanies the black liquor into the recovery boiler, and an important amount of energy is consequently required for its evaporation. The evaporated water leaves the boiler with the flue gases, and the heat of evaporation cannot then be recovered in any other way than by condensation of the water out of the flue gases. However, in order that the water might be condensed, the flue gases must be cooled strongly, and therefore the temperature of the recovered vapour becomes maximally about 65° C. At present, recovery with a flue gas scrubber is usual. In addition to a heat recovery, a purification of the flue gases is also obtained, chiefly from $SO_2$ and dust.

It would be desirable to carry the evaporation of the black liquor further, so that the heat required to evaporate water included in the liquor would be utilized instead to produce steam in the soda recovery boiler. A prerequisite for an energy gain to obtained is then of course that the amount of heat from the boiler increases more than the amount of heat required to carry the evaporation of the liquor further. In order that a low energy consumption might be obtained at the evaporation, this can in principle be carried out by two different methods. In the first method, the evaporation is carried out by means of waste heat having a very low value. In the other method, the evaporation takes place at a higher temperature so that the heat consumed can be recovered as first-rate heat.

By definition, waste heat has a low temperature, and an evaporation of the liquor by such heat should therefore require that the evaporation takes place at a low temperature. However, at low temperatures the viscosity of the black liquor increases very rapidly as it is concentrated, and finally the liquor will solidify and cannot be handled. Thus, the first method of evaporation is not practically feasible.

In order that the liquor may be handled as a liquid of a moderate viscosity, it is thus necessary to carry out the evaporation at a high temperature. The evaporation is then carried out a pressure above atmospheric, and it is desired to obtain steam of such a temperature and pressure at the evaporation that it can be re-utilized as first-rate heat or nearly so, such as for evaporation of the black liquor in effect two.

However, evaporation of black liquor to a high solids content at a high temperature is also associated with considerable difficulties. Thus, at the temperatures and solids contents used, the liquor has a very great tendency to form scale, so that the heat exchange is impaired in this way and is finally made quite impossible. Accordingly, it is not possible to achieve by normal evaporation, even at a high temperature and a high pressure, in a way practically feasible such a high solids content of the evaporated spent liquor as desired.

The drawbacks indicated above are eliminated by the present invention, and it will be possible to obtain a black liquor having a high solids content up to about 85% without encountering problems with formation of scale at the concentration, and without the liquor having too great a viscosity to be handled as a liquid. The amount of water introduced into the soda recovery boiler together with the liquor at its combustion is thus considerably reduced in this way, such that the efficiency of the soda recovery boiler is thereby increased. At the concentration of the liquor, steam of a relatively high value is also obtained which can be used for the liquor evaporation in previous steps, such as in effect two.

According to the invention, the solids content of black liquor is increased at its recovery in a sulfate pulping process in such a way that the liquor is first heated at a pressure which is so high that no boiling takes place at the heating temperature used, after which the liquor is led to a container where its pressure is released to a value below the saturation pressure of steam at the prevailing temperature of the liquor so that water is evaporated, after which the liquor thus concentrated is led to combustion.

If required, a part of the liquor from the pressure release can be recycled to the heating at the higher pressure so that an additional concentration is obtained.

The invention is illustrated more in detail with reference to the accompanying drawing. The drawing figure shows schematically a flow chart of the concentration process of black liquor according to the invention.

From the mixing tank 1 the black liquor, which has previously been subjected to a conventional evaporation in one or more steps, is pumped through the line 2 and the regulating valve 4 by means of the pump 3 to a pressure boosting pump 5. This pump is necessary for pressurizing the liquor sufficiently for boiling not to take place. The liquor is led from the pump 5 to the heat exchanger 6 where it is heated by means of steam supplied through the line 7. The steam supply is adjusted by means of the regulating valve 8. In the heat exchanger 6, the liquor is heated to a temperature of at least about 200° C., and preferably at least about 220° C., and a pressure of 15–30 bar is maintained, so that no boiling occurs. In this way the risk of scale being formed in the heat exchanger 6 is strongly reduced.

The amount of condensate led away (not shown) from the heat exchanger 6 has still a high temperature and a high pressure and is therefore quite useful as a high-grade heating medium for other purposes, such as in the prelimary evaporation of the black liquor.

The heated and pressurized liquor is led from the heat exchanger 6 through the line 9 and the pressure regulating valve 10 to the flash tank 11, where its pressure is released to a value below the saturation pressure of steam at the relative temperature. The pressure of the liquor is usually lowered to 1–4 bar above atmospheric, and preferably about 3.6 bar above atmospheric.

At the flashing, steam is released through the line 12 and the pressure regulating valve 13. This steam is of a secondary value and can preferably be used in effect two at the preliminary evaporation of the black liquor.

The concentrated liquor is taken out of the tank 11 through the line 14, and if it is desired to concentrate it further, a part thereof can be recycled through the line 15 to the inlet line 2 before the pressure boosting pump 5 to pass through the heat exchanger 6 and the flash tank 11 once more. By a suitable adjustment of the recycled amount of liquor through the line 15, a suitable concentration degree of the liquor can thus be obtained.

The concentrated liquor is conducted away through the line 16, the pump 17 and the pressure regulating valve 18 to the injection nozzle 19 in the soda recovery boiler 20. A plurality of nozzles 19 are usually arranged in the soda recovery boiler so that a suitable combustion is obtained. The pump 17 is not absolutely necessary but the remaining pressure after the pressure release in the container 1 can be sufficient to force the liquor to the injection nozzles 19. However, it is normally suitable to increase the pressure of the liquor after the release as one otherwise runs the risk that the pressure release container in the line 16 and flashing takes place there, which is quite undesired for a good function of the soda recovery boiler.

It is important that the liquor is maintained at a definite and constant pressure when it is introduced into the soda recovery boiler and at its introduction into the flash tank 11. For this, pressure regulators 21 and 22 are arranged in the line 9 and 16, respectively, which sense the pressure in the relative line and adjust it to an established desired value by means of the pressure regulating valves 10 and 18.

Furthermore, the density of the concentrated liquor is measured by means of the sensors 23 and 24 and the temperature corrected value is fed into the regulator 25. The amount of liquor recycled to concentration through the line 15 as well as the pressure of the heating vapour to the heat exchanger 6 are controlled by the regulator 25. In this way a too low measured value of the density will then actuate the regulator 25 so that a greater amount of liquor is returned to further concentration and also that the pressure of the heating steam to the heat exchanger 6 is increased so that the incoming liquor is heated to a higher temperature. This leads to a more extensive concentration exactly as desired.

The viscosity of the concentrated liquor to the combustion is also measured, and is sensed by the regulator 26. This emits a signal to the pressure regulator 27 which controls the pressure of the secondary steam from the flash tank 11. The viscosity will thereby be controlled by the change of the liquor temperature with the pressure of the secondary steam, so that an increasing viscosity leads to an increased pressure. This brings a higher temperature of the liquor, such that its viscosity is reduced to the desired value.

Finally, the level of the liquor in the flash tank 11 is also sensed and the value found actuates the level regulator 28 which controls the regulating valve 4, such that the level is maintained at a desired value.

It is important that the dry content and viscosity of the liquor are maintained at a constant value in the line to the injection into the soda recovery boiler so that an even distribution of the liquor in the soda recovery boiler is obtained.

The various elements included in the plant such as mixing tank, heat exchanger, flash tank and soda recovery boiler as well as the various control means are of a conventional design which is well-known to one skilled in the art. Thus, for carrying out the process of the invention, no equipment of any special design is required, but with a knowledge of the used pressures, temperatures, liquor concentrations and other parameters, one skilled in the art can design a suitable plant, once he is informed about the process of the invention.

In order to further ensure that scale will not form in the heat exchanger 6, this can be of a special design with scraped heat transfer surfaces. Such heat exchangers are also previously known to one skilled in the art.

At a simple passage of the liquor through the heat exchanger and the flash tank without any recirculation, the solids content of the liquor can be increased from about 65% by weight with about 8 percentage units if the liquor is heated to about 220° C. The solids content of the liquor can then be increased by recirculation to a desired level above this value. However, if the pressure in the flash tank is maintained at about 1 bar above atmospheric, the possible solids content is restricted to about 80% if the viscosity should not be too high. At a pressure of about 4 bar above atmospheric in the flash tank, the solids content of the liquor can be increased to about 85%.

In the following table, calculated results of some different solids contents are shown as compared with 65% solids content.

The heat value in the steam to the evaporation is calculated as the difference in enthalpy between the secondary steam and the condensate at the saturation temperature 120° C.

The coefficient of heat transfer has been calculated starting from measurement data of an existing heat exchanger. These data have thereafter been recalculated taking into account the current viscosity.

The increase of the power of the soda recovery boiler has been calculated from the reduced evaporation of water in the liquor and the change of sensible heat in the liquor to the boiler. The temperature of the flue gases has been assumed to be unchanged.

In the calculation of the net savings, the steam to evaporation has been given the valency of 0.8, as it cannot be utilized in the first effect. No correction has been made for reduced generation of hot water in the flue gas scrubbers of the soda house.

The total heat emission in the soda recovery boiler is about 11 MJ per kg of solids, and therefore the possible net increase of produced heat corresponds to 1–5%, depending on the solids content of the burnt liquor.

TABLE 1

| | | | | | | |
|---|---|---|---|---|---|---|
| Liquor from mixing tank | | | | | | |
| Dry content | % | 65.0 | 65.0 | 65.0 | 65.0 | 65.0 |
| Temperature | °C. | 110 | 110 | 110 | 110 | 110 |
| Viscosity | cP | 58 | 58 | 58 | 58 | 58 |
| Liquor to heat exchanger | | | | | | |
| Dry content | % | 65.0 | 65.0 | 65.0 | 68.0 | 71.0 |
| Temperature | °C. | 110 | 110 | 110 | 118 | 124 |
| Viscosity | cP | 58 | 58 | 58 | 65 | 84 |
| Liquor from heat exchanger | | | | | | |
| Dry content | % | 65.0 | 65.0 | 65.0 | 68.0 | 71.0 |
| Temperature | °C. | 180 | 200 | 220 | 220 | 220 |
| Viscosity | cP | 7 | 5 | 4 | 5 | 6 |
| Liquor to boiler | | | | | | |
| Dry content | % | 69.1 | 71.1 | 73.4 | 76.3 | 79.2 |
| Temperature | °C. | 138 | 139 | 140 | 143 | 145 |
| Viscosity | cP | 35 | 46 | 64 | 109 | 208 |
| Steam to heat | | | | | | |

TABLE 1-continued

| | | | | | | |
|---|---|---|---|---|---|---|
| exchanger, saturation temp. | °C. | 235 | 235 | 235 | 235 | 235 |
| k-value KW/°C. | $m^2$ | 0.63 | 0,65 | 0.66 | 0.63 | 0.59 |
| Heat exchanger surface | | | | | | |
| 1 kg/s solids | $m^2$ | 5.9 | 9.0 | 14.9 | 20.3 | 26.5 |
| Recirculated share in heat exchanger | % | 0.0 | 0.0 | 0.0 | 26.5 | 42.1 |
| Power of heat exchanger | KJ/kg solids | 317 | 413 | 511 | 634 | 748 |
| Steam to evaporation | KJ/kg solids | 203 | 296 | 392 | 511 | 620 |
| Increase soda recovery boiler | KJ/kg solids | 317 | 413 | 510 | 632 | 744 |
| Net saving | KJ/kg solids | 162 | 236 | 312 | 407 | 492 |

It is clearly apparent from the table that essential savings of energy are obtained by the process of the invention, also considering the energy required to concentrate the black liquor further before it is burned. At an evaluation of the construction costs, in a plant with a prouction of about 600 tons of pulp/24 h it can be found that the apparatus pays its own costs in about 1–2 years, depending on the price of energy. This must be regarded as very advantageous.

Besides the energy gains indicated here, other advantages can also be obtained by the process of the invention in the operation of the soda recovery boiler, namely that the gas volumes handled are reduced and that a higher loading of the fireplace can be maintained. Because to this, an increased capacity is obtained at an unchanged boiler size.

What I claim is:

1. A process for increasing the solids content of an aqueous black liquor recovered from a sulfate pulping process, comprising the steps of:

heating the black liquor to a temperature of at least about 200° C. and at a first pressure sufficient to maintain said black liquor in a liquefied state; and evaporating a substantial portion of the water in said black liquor by reducing said first pressure to a second pressure of from about 1 to about 4 bars about atmospheric;

wherein said evaporation step increases the solids content of said black liquor to above about 65% by weight, thereby forming a concentrated liquor, the first pressure being reduced in the evaporating step by means of a pressure regulating valve;

measuring the viscosity of the concentrated liquor; and adjusting the second pressure according to the measured viscosity such that the viscosity is reduced to a desired value and the solids content is maintained at above about 65% by weight.

2. The process of claim 1, wherein said heating step is conducted in a heat exchanger, and wherein said evaporation step is conducted in a flash tank.

3. The process of claim 1, wherein said evaporation step increases the solids content of said black liquor from below about 65% up to about 80%.

4. The process of claim 1, wherein said evaporation step increases the solids content of said black liquor from below about 65% up to about 85%.

5. The process of claim 1, wherein said process includes evaporating said black liquor prior to said heating step.

6. The process of claim 1, wherein a portion of the concentrated liquor is recycled to the heating step.

7. The process of claim 6 further comprises the step of measuring the density of the concentrated liquor regulating both the amount of concentrated liquor recycled to the heating step and the temperature to which the black liquor is heated in the heating step according to the measure density, such that a desired density of th e concentrated liquor is obtained.

8. The process of claim 1, wherein the concentrated liquor is led to a combustion, and wherein the pressure of said concentrated liquor is raised prior to being led to the combustion.

9. The process of claim 1, wherein the black liquor is heated to a temperature of at least about 220° C. in the heating step.

10. The process of claim 1, wherein the second pressure is about 3.6 bars above atmospheric.

11. A process for increasing the solids content of black liquor at its recovery in a sulfate pulping process comprising the steps of:

heating the liquor to a temperature of at least 200° C. at a pressure of 15 to 30 bars such that no boiling occurs;

conducting the heated liquor via a pressure regulating valve to a tank where is pressure is lowered to 1 to 4 bars above atmospheric so that a concentrated liquor is formed;

passing the concentrated liquor to combustion;

recycling a part of the liquor from the pressure lowering step to the heating at the higher pressure;

measuring the density of the concentrated liquor being passed to combustion; and adjusting both the amount of liquor recycled to the heating at the higher pressure and the pressure in said tank according to the measured density, such that a desired density of the concentrated liquor to combustion is obtained.

12. A process for increasing the solids content of black liquor at its recovery in a sulfate pulping process heating at a pressure such that no boiling occurs at the heating temperature, after which the pressure is released to a value which is below the saturation pressure of steam at the prevailing temperature of the liquor, so that water is evaporated, comprising the steps of:

heating the liquor to a temperature of at least 200° C. at a pressure of 15 to 30 bars;

conducting the heated liquor to a pressure regulating valve to a tank where its pressure is lowered to 1 to 4 bars above atmospheric to obtain a concentrated liquor passing the concentrated liquor to combustion;

measuring the viscosity of the concentrated liquor being pass to combusiton;

adjusting the pressure at the pressure lowering step according to the measured viscosity such that the viscosity is reduced to a desired value and the solids content is maintained at about 65% by weight.

* * * * *